US011680457B2

(12) United States Patent
Bråthen et al.

(10) Patent No.: US 11,680,457 B2
(45) Date of Patent: Jun. 20, 2023

(54) SUBSEA BLIND STAB DEVICE

(71) Applicant: FMC Kongsberg Subsea AS, Kongsberg (NO)

(72) Inventors: Kai Bråthen, Kongsberg (NO); Ole-Halvard Smetbak, Veggli (NO); Magne Aarvelta, Veggli (NO)

( * ) Notice: Subject to any disclaimer, the term of this patent is extended or adjusted under 35 U.S.C. 154(b) by 0 days.

(21) Appl. No.: 17/800,499

(22) PCT Filed: Feb. 17, 2021

(86) PCT No.: PCT/EP2021/053914
§ 371 (c)(1),
(2) Date: Aug. 17, 2022

(87) PCT Pub. No.: WO2021/165336
PCT Pub. Date: Aug. 26, 2021

(65) Prior Publication Data

US 2023/0079184 A1 Mar. 16, 2023

(30) Foreign Application Priority Data

Feb. 17, 2020 (NO) ..... 20200206

(51) Int. Cl.
*E21B 33/035* (2006.01)
*E21B 41/04* (2006.01)

(52) U.S. Cl.
CPC ..... *E21B 33/0387* (2020.05); *E21B 41/04* (2013.01)

(58) Field of Classification Search
CPC ..... E21B 33/035; E21B 33/0387; E21B 41/04
See application file for complete search history.

(56) References Cited

U.S. PATENT DOCUMENTS

| | | | | |
|---|---|---|---|---|
| 4,863,314 | A | 9/1989 | Baugh | |
| 5,988,281 | A * | 11/1999 | Douglas | E21B 33/038 166/344 |
| 2005/0087232 | A1 | 4/2005 | Kugelev et al. | |
| 2008/0087436 | A1 | 4/2008 | Baskett | |
| 2013/0334448 | A1 * | 12/2013 | Hodnefjell | E21B 33/038 251/304 |

FOREIGN PATENT DOCUMENTS

| | | | |
|---|---|---|---|
| WO | WO 98/39548 | A1 | 9/1998 |
| WO | WO 2014/206831 | A1 | 12/2014 |

* cited by examiner

*Primary Examiner* — Matthew R Buck

(57) ABSTRACT

A subsea blind stab (100), comprises a stabbing part (110) for insertion into a hot stab receptacle, the stabbing part (110) including a housing, a central rod (150) slidably arranged within the housing and at least one fluid communication line from the external side of the stabbing part (110) to an internal fluid communication line (180) within the rod (150). The at least one fluid communication line is open in a first position of the rod (150) relative the housing and closed in a second position of the rod (150) relative the housing. The stab (100) further comprises a hollow body (120) attached to one end of the stabbing part (110); a piston (130) slidably arranged in the hollow body (120), with a spring element (160) arranged between the piston (130) and a spring attachment element (170) connected to the body. A first side of the piston (130) forms a fluid chamber (140) in the hollow body. The fluid chamber (140) is in fluid communication with the internal fluid communication line in the rod, and a second side of the piston (130) is exposed to a pressure of the surrounding environment.

14 Claims, 4 Drawing Sheets

SECTION A-A

SUBSEA BLIND STAB DEVICE

TECHNICAL FIELD

The invention relates to a subsea blind stab device and a method for protecting a subsea equipment.

BACKGROUND

A stab, also known as a "hot stab", is a subsea hydraulic connecting device for hydraulic fluid transmission, for instance between a hydraulic power unit localized topside and an equipment (e.g., a hydraulically operated tool) localized subsea, for instance on the seafloor. Essentially, a stab is a hydraulic quick-acting coupling designed for subsea conditions.

A stab connects to a receptacle arranged on the subsea equipment or tool. Usually the connection operation and the corresponding disconnection operation is performed subsea by the use of a Remotely Operated Vehicle, ROV.

A regular type of stab, also known as a "live stab" or an operating hot stab, provides a fluid communication between a hydraulic fluid source and the subsea equipment. When the regular stab is disconnected from the subsea equipment, it is necessary to shield the receptacle from the seawater and subsea conditions so that seawater does not enter the subsea equipment or fluid inside the equipment does not spill to the surrounding sea.

To this end, a blind stab, also known as a plug stab or dummy stab, is inserted in the receptacle, acting as a placeholder to protect the hot stab receptacle of the subsea equipment while an operating hot stab is not present. Also, the blind stab serves to prevent hydraulic fluid from leaking from the equipment and out to the environment during transportation and lowering/hoisting operations between the seabed and the surface.

Such blind stabs have the disadvantage that they do not always sufficiently prevent ingression of seawater and possibly other contaminants into the hydraulic system of the subsea equipment, particularly under variable conditions, including ambient conditions at topside and subsea locations.

US 2013/0334448A1 shows a prior art hot stab for a valve that has a fixed part provided with at least one fluid port and a rotatable sleeve provided with at least one bore. The sleeve is structured in a manner allowing it to rotate the bore in-line with the fluid port in order to allow a fluid to flow through the fluid port and the bore when the sleeve is in an open position.

SUMMARY OF THE INVENTION

There is a need for a blind stab device which overcomes disadvantages of a regular dummy stab. In particular, there is a need for a blind stab device which improves prevention of ingression of seawater and possibly other contaminants into the hydraulic system of the subsea equipment under variable conditions, in particular pressure conditions, at topside and subsea locations.

The invention relates to a subsea blind stab device and a method for protecting a subsea equipment as set forth in the appended claims.

According to a first example aspect, the present invention provides a subsea blind stab comprising a stabbing part for insertion into a hot stab receptacle, including a housing, a central rod slidably arranged within the housing, and at least one fluid communication line from the external side of the stabbing part to an internal fluid communication line within the rod, wherein the at least one fluid communication line is open in a first position of the rod relative the housing and closed in a second position of the rod relative the housing. The stab further comprises a hollow body attached to one end of the stabbing part, a piston slidably arranged in the hollow body, with a spring element arranged between the piston, and a spring attachment element connected to the body; wherein a first side of the piston forms a fluid chamber in the hollow body, the fluid chamber being in fluid communication with the internal fluid communication line in the rod, and wherein a second side of the piston is exposed to a pressure of the surrounding environment.

The rod may be arranged slidably extending through a bore in the piston.

The spring element may be arranged around the rod, at the second side of the piston.

A check valve may be arranged between the fluid chamber and the surrounding environment. The check valve may be arranged in the piston.

An end of the rod may be provided with a ROV handle. The end of the rod may also be provided with a position indicator which indicates if the rod is in its first or second position.

The second side of the piston may be exposed to the surrounding environment, e.g. the surrounding sea, by means of at least one aperture through the body.

The body may be formed by two end sections and a side wall.

The stabbing part and the body may be substantially cylindrical and coaxial.

The subsea blind stab may further comprise a rotary-to-linear conversion mechanism, converting a rotational operation of the ROV handle to an axial movement of the rod.

The fluid chamber may be filled with hydraulic fluid at a predetermined pressure.

According to a second example aspect, the present invention provides a method for protecting a subsea equipment, comprising the step of inserting a subsea blind stab according to the first example aspect into a hot stab receptacle of the subsea equipment, or removing a subsea blind stab according to the first example aspect from a hot stab receptacle of the subsea equipment.

The method may be performed at a subsea location by a Remotely Operated Vehicle, ROV.

DETAILED DESCRIPTION

Figure 1:
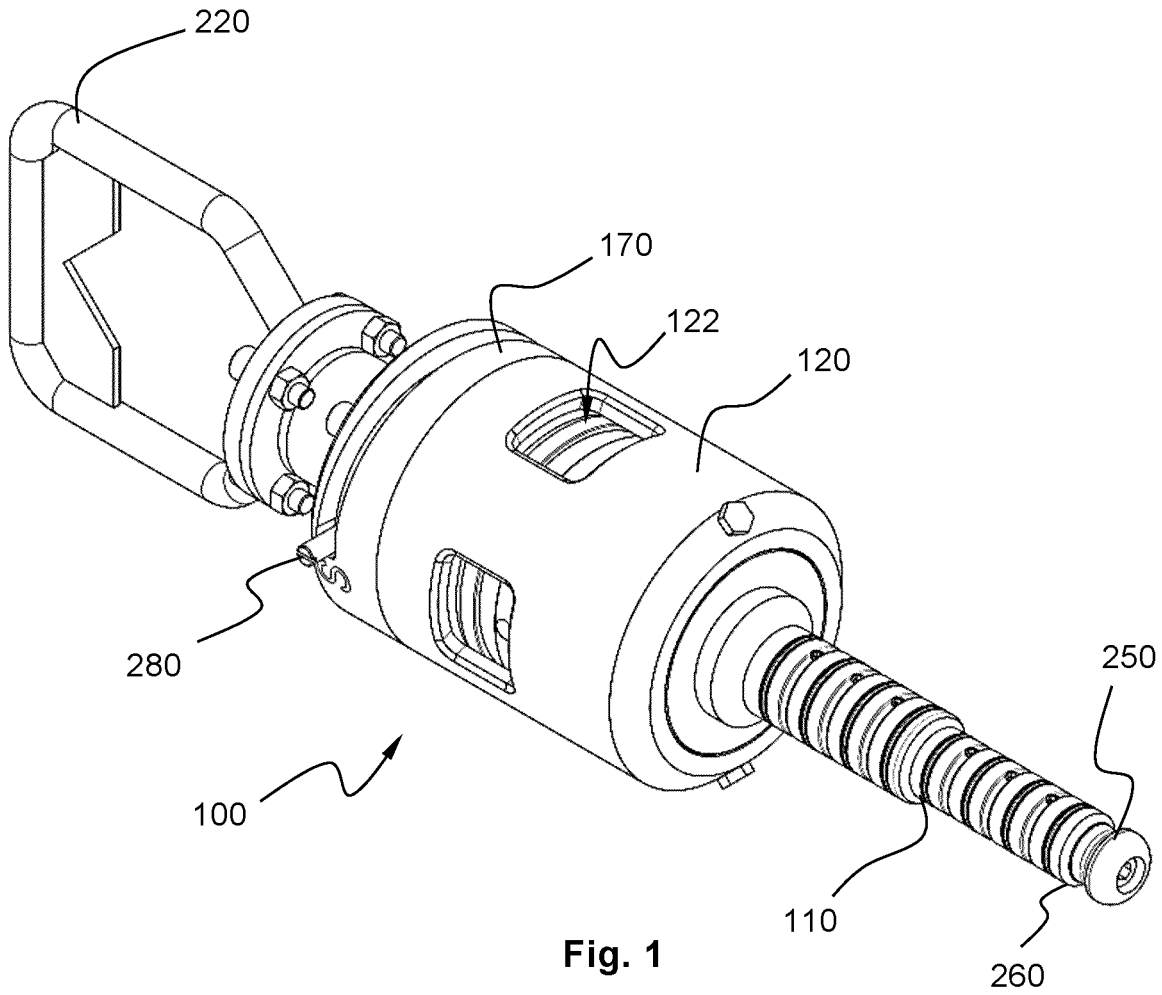
FIG. 1 is a perspective view illustrating basic principles of a subsea blind stab.

FIG. 1 is a perspective view illustrating basic principles of a subsea blind stab 100 according to the invention.

The subsea blind stab 100 comprises a stabbing part 110 for insertion into a hot stab receptacle (not shown). The hot stab receptacle may typically be a hot stab receptacle of a subsea equipment, including a subsea tool.

As shown, the stabbing part 110 may be substantially cylindrical. The stabbing part 110 may have a tapered or conical shape, with a diameter that decreases in the direction of the stabbing part's distal, free end 260. The stabbing part may have various sections along its length, and the decreasing diameter of the stabbing part may make a transition from one section to another. Various standards exist for the design of the stabbing part 110 and the corresponding hot stab receptacle.

The stabbing part 110 has a housing 112 and includes a central rod that is slidably arranged within the housing, and at least one fluid communication line from the external side of the stabbing part 110 to an internal fluid communication line within the rod. These and other further features of the subsea blind stab 100 have been described in further detail below with reference to FIGS. 2 and 3.

The subsea stab 100 further comprises a hollow body 120 which is attached to one end of the stabbing part 110, in particular the proximate end of the stabbing part, i.e. the end opposing the stabbing part's distal end 260. The hollow body 120 may advantageously be substantially cylindrical. Advantageously the body is coaxially attached to the proximal end of the stabbing part 110, i.e. the body 120 and the stabbing part 110 have a common axis. The hollow body 120 has an internal cavity with a piston slidably arranged in the cavity, and a spring element, which has been described in further detail below with reference to FIGS. 2 and 3.

Figure 2:
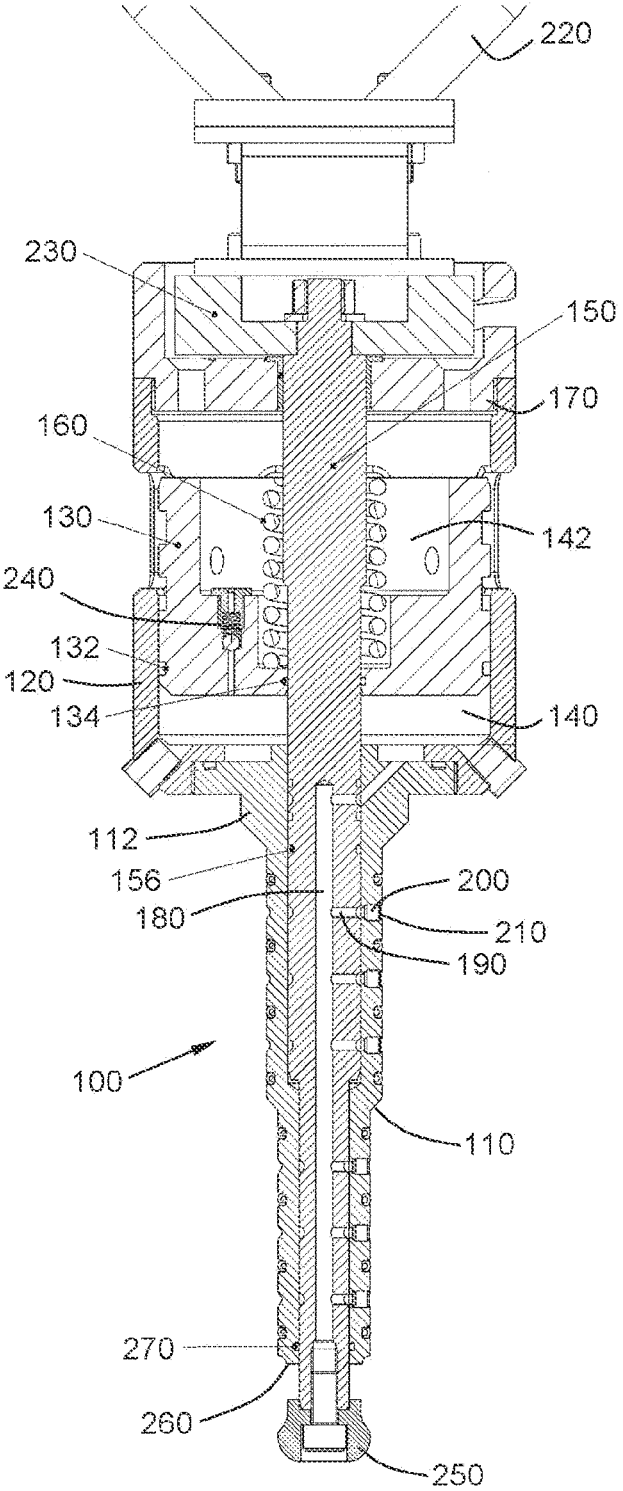
FIG. 2 is a sectional view illustrating further principles of a subsea blind stab.
Figure 3:
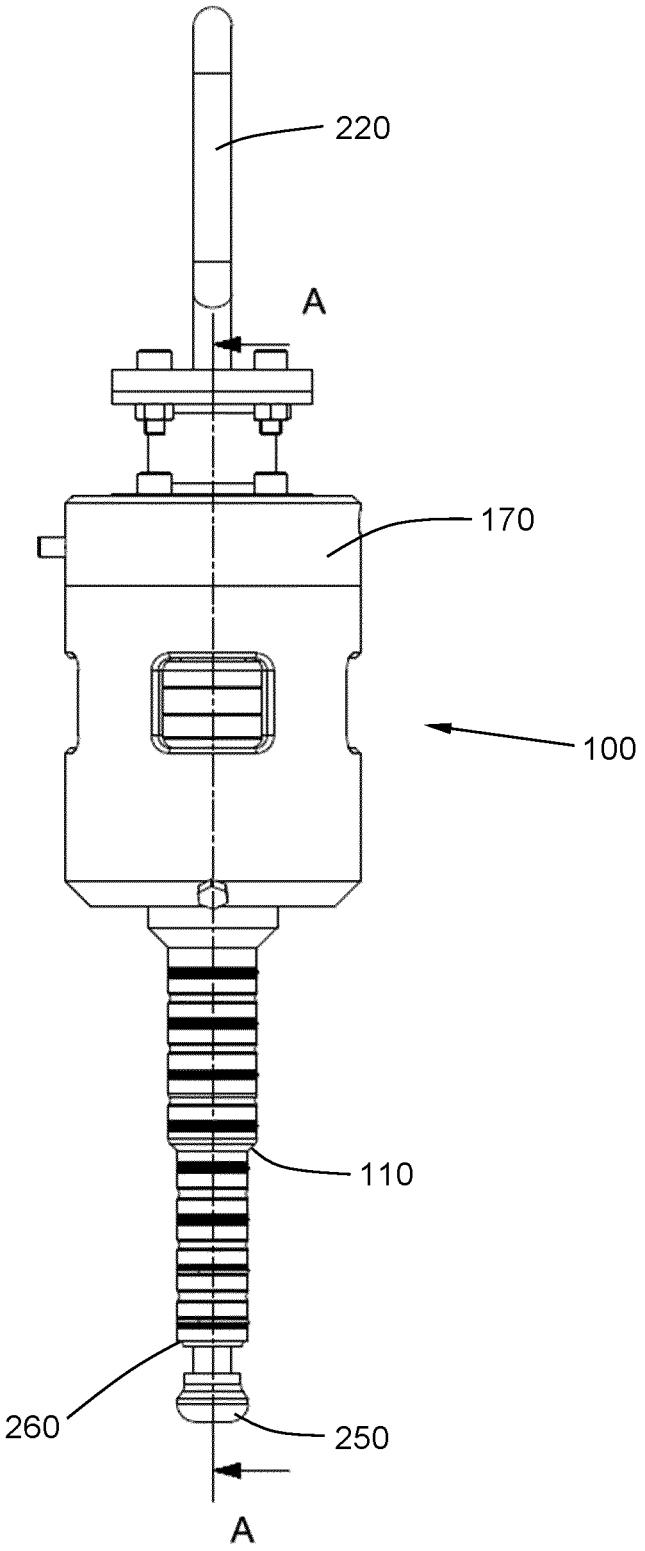
FIG. 3 is a side view illustrating principles of a subsea blind stab.

FIG. 2 is a sectional view illustrating further principles of the subsea blind stab 100, and FIG. 3 is a side view of reduced size with respect to FIG. 2, also illustrating further principles of a subsea blind stab. The section shown in FIG. 2 has been taken along the line shown as A-A in FIG. 3.

The subsea blind stab 100 comprises a stabbing part 110 for insertion into a hot stab receptacle (not shown) of a subsea equipment, including a subsea tool. The stabbing part 110 comprises a housing 112, a central rod 150 slidably arranged within the housing 112 and at least one fluid communication line 190, 200 from the external side of the stabbing part 110 to an internal fluid communication line 180 (also referred to herein as a fluid connection bore) within the rod 150. The internal fluid communication line 180 is open in a first position of the rod 150 relative the housing 112 and closed in a second position of the rod 150 relative the housing 112.

The subsea blind stab 100 has at least two states, an open state and a closed state. In the open state of the blind stab 100, fluid connection is provided between an exterior of the stabbing part 110 and the fluid connection bore 180, and further to the fluid chamber 140. In the closed state of the blind stab 100, fluid connection is prevented between the exterior of the stabbing part 110 and the fluid connection bore 180.

The fluid communication line 190, 200 provides fluid communication between the exterior of the cylindrical stabbing part 110 and the fluid connection bore 180 through a radial bore 190 provided in a side wall of the central rod and through a corresponding radial connection bore 200 provided in a side wall of the cylindrical stabbing part 110. The radial bore 190 in the side wall of the central rod and the radial bore 200 in the side wall of the stabbing part 110 are aligned in the open state of the blind stab 100. In the closed state of the blind stab 100, the connection is blocked.

Consequently, when the blind stab 100 is inserted into a hot stab receptacle of a subsea equipment (not shown) and in an open state, the radial bores 190 and 200 will be in fluid communication with subsea equipment.

As illustrated in FIG. 2, there may be more than one fluid communication line 200 from the external side of the stabbing part 110 to the internal fluid communication line 180 within the rod 150. Six such communication lines have been shown in FIG. 2. Therefore, a plurality of radial connection bores 190 may advantageously be provided in the side wall of the central rod, and a corresponding plurality of radial connection bores 200 may be provided in the side wall of the cylindrical stabbing part.

Still further, in this embodiment, a closure screw 210 may advantageously be inserted into at least one of the radial connection bores 200 provided in the side wall of the cylindrical stabbing part 110. At least one radial connection bore 200 should be open, i.e., not be provided with a closure screw, to ensure proper operation of the subsea blind stab 100. Alternatively, all the radial connection bores 200 may be open, in this case no closure screw 210 is inserted.

The subsea blind stab 100 further comprises a hollow body 120 attached to one end of the stabbing part 110, in particular the proximate end of the stabbing part 110, i.e., the end opposing the stabbing part's distal end 260. A piston 130 is slidably arranged in the hollow body 120. A spring element 160, advantageously a compression spring, is arranged between the piston 130 and a spring attachment element 170 connected to the body 120.

A first side of the piston 130 forms a fluid chamber 140 in the hollow body 120. The fluid chamber 140 is in fluid communication with the internal fluid communication line in the rod 150, and a second side of the piston 130 forms a fluid chamber 142 which is exposed to a pressure of the surrounding environment via the apertures 122 (see FIG. 1). Consequently, when the blind stab 100 is topside, the second side of the piston 130 will be in contact with the surrounding atmosphere and when submerged with surrounding seawater.

As previously stated, the subsea blind stab 100 can be operated between an open state and a closed state. In normal operation, the blind stab 100 will be brought to the open state only once it has been inserted into the hot stab receptacle of the subsea equipment. Prior to being removed from the hot stab receptacle, the blind stab 100 will be brought back to the closed state. In the open state, which is illustrated in FIG. 2, the radial bores 190 are aligned with the radial bores 200 and, consequently, the axial bore 180 is in fluid communication with the radial bores 200. Also, in the open state the axial bore 180 is in fluid communication with the fluid chamber 140. Consequently, in the open state of the subsea blind stab 100, the fluid chamber 140 will be in fluid communication with the mantle surface of the stabbing part 110 at the region of the radial bores 200 and also with the distal end of the stabbing part 110 (due to the fact that the axial bore 180 is open at the distal end). Consequently, when the blind stab 100 is inserted into the hot stab receptacle and brought to the open state, the fluid chamber 140 will be in fluid communication with the subsea equipment via the radial bores 190, 200 and the opening in the distal end of the stabbing part 110.

Figure 5:
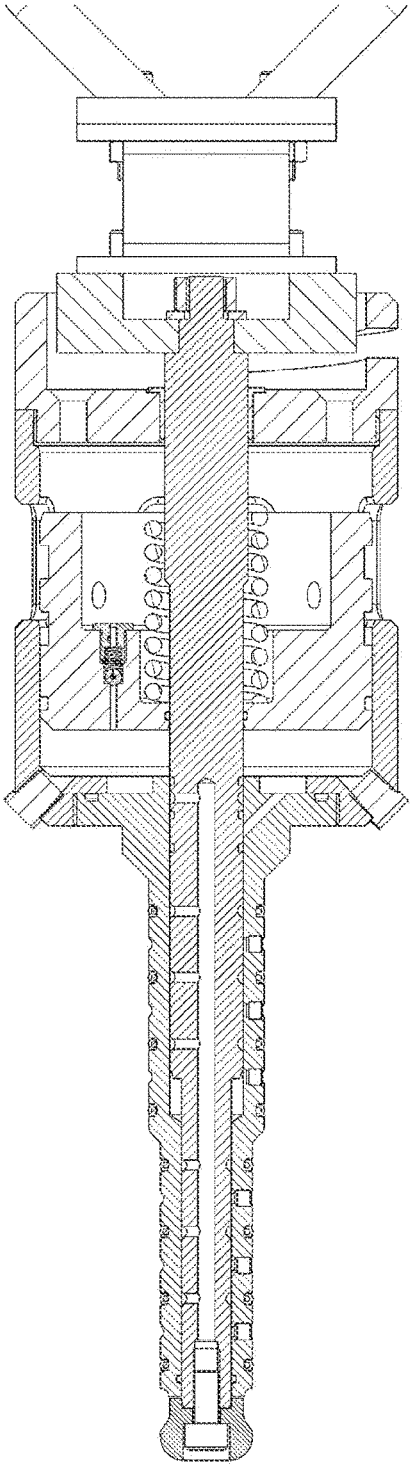
FIG. 5 is a sectional view illustrating further principles of a subsea blind stab.

When the subsea blind stab 100 is brought to the closed state, which is illustrated in FIG. 5, the radial bores 190 no longer line up with the radial bores 200 and, consequently, the fluid communication paths between the axial bore 180 and the radial bores 200 are broken. The fluid communication path between the axial bore 180 and the fluid chamber 140 is also broken when the subsea blind stab 100 is brought to the closed state. Consequently, in the closed state the subsea blind stab allows no fluid exchange with the receptacle in which it is positioned and fluid in the in the fluid chamber 140 will be isolated from the surroundings also when the blind stab 100 is withdrawn from the hot stab receptacle.

Advantageously, as shown, the rod 150 is arranged slidably extending through a bore in the piston 130. The rod 150 is also advantageously arranged in a slidable manner, centrally through an axial bore in the stabbing part 110.

Advantageously, the spring element 160 is arranged coaxially around the rod 150, at the second side of the piston 130.

Advantageously, a check valve 240 is arranged between the fluid chamber 140 and the surrounding environment or a location which has a pressure corresponding to the pressure of the surrounding environment. In the illustrated embodiment, the check valve 240 is advantageously arranged in the piston 130. Alternatively, the check valve 240 may be arranged in a side wall of the hollow body 120.

In any of the disclosed configurations, an end of the rod 150, in particular the end opposite the stabbing part's distal end 260, is advantageously provided with a ROV handle 220. Only a part of the ROV handle has been shown in FIG. 2. The ROV handle 220 is intended to be operated by an external ROV. In this aspect, the central rod 150 is axially movable between its first position, corresponding to the open state of the blind stab 100, and its second position, corresponding to the closed state of the blind stab 100, by operation of the ROV handle 220. The end of the rod 150 which is provided with the ROV handle 220 may be provided with a position indicator 280 which indicates if the rod 150 is in its first or second position.

In any of the disclosed configurations the second side of the piston 130 is advantageously exposed to surrounding environment by means of at least one aperture 122 through the hollow body 120. In particular, the hollow body 120 may be formed by two end sections and a side wall.

In any of the disclosed configurations, the stabbing part 110 and the body 120 are advantageously substantially cylindrical and coaxial, i.e., they are arranged in a coaxial manner with respect to each other. In this case, the subsea blind stab 100 may advantageously further comprise a rotary-to-linear conversion mechanism 230 which converts a rotational operation of the ROV handle 220 to an axial movement of the rod 150.

In any of the disclosed configurations of the subsea blind stab 100, the fluid chamber 140 is advantageously filled with hydraulic fluid at a predetermined pressure.

Advantageously, a distal end of the central rod 150 includes a nose element 250. The nose element 250 may advantageously have a rounded outer shape. This may have the effect of facilitating the insertion of the blind stab 100 into a hot stab receptacle.

In any of the disclosed embodiments and aspects, the subsea blind stab 100 may advantageously comprise sealing O-rings provided between any slidably arranged elements. Such O-rings are shown at 132, 134, 156 and 270 in FIG. 2.

The stabbing part 110, the central rod 150, the hollow body 120, the piston 130, the ROV handle 220, any closure screws, etc., are advantageously made of materials with high strength and hardness and which are able to withstand highly corrosive environment, in particular sea water, and varying pressure and temperature conditions, both at topside and subsea locations. Typically, a corrosive-resistant steel alloy is used.

The disclosed subsea blind stab 100 may be used for protecting a subsea equipment. To this end, a method has been provided for protecting a subsea equipment, which comprises removing a subsea blind stab 100 from a hot stab receptacle of the subsea equipment, and/or inserting the subsea blind stab 100 into a hot stab receptacle of the subsea equipment. These steps of a method for protecting a subsea equipment is advantageously performed subsea by a ROV.

Figure 4:
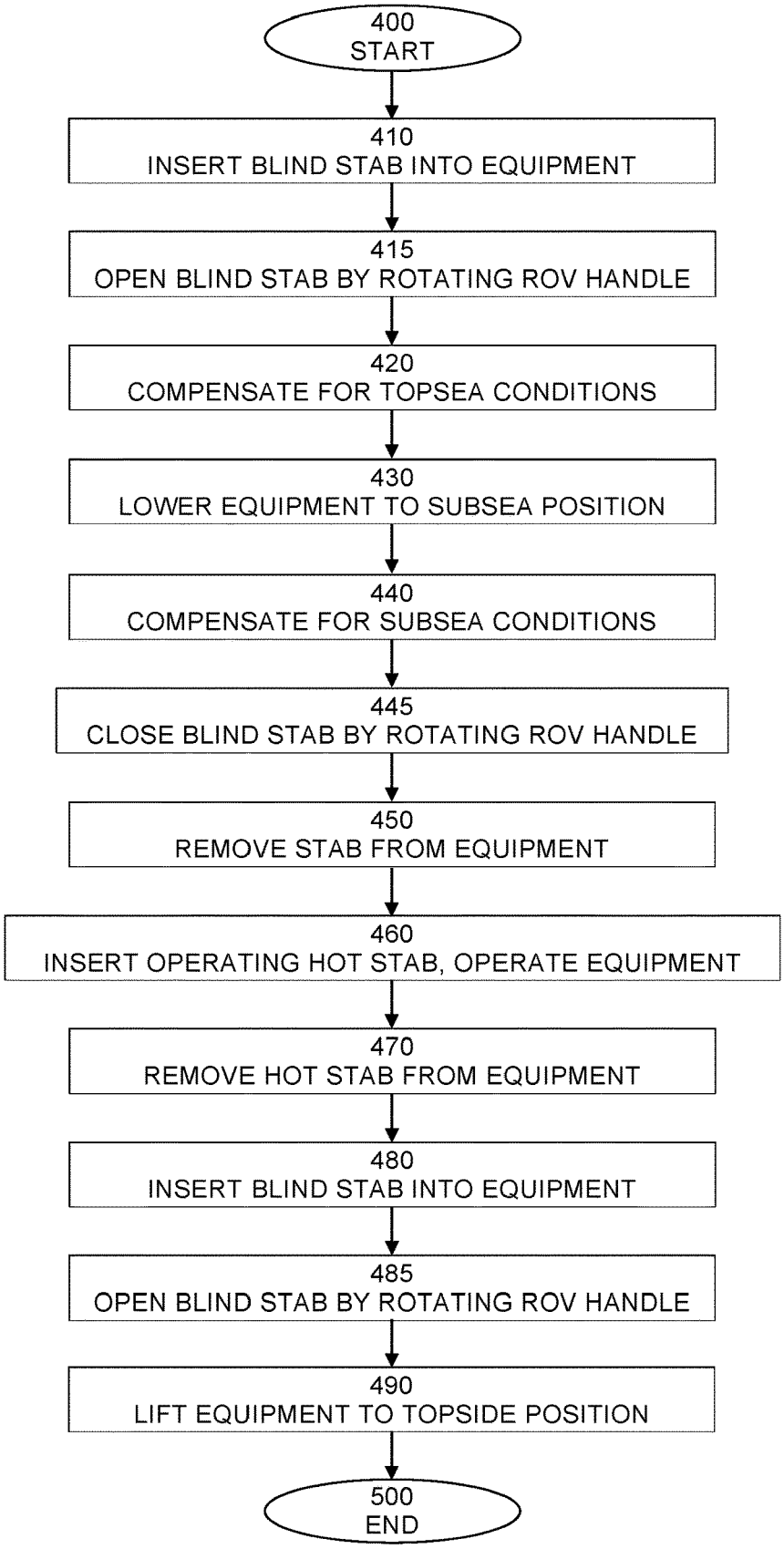
FIG. 4 is a schematic flow chart illustrating principles of a method wherein the blind stab is used.

Further possible features or steps of such a method appears from the following description of a method wherein the disclosed blind stab is used, illustrated in the schematic flow chart of FIG. 4.

The method starts at the initiating step 400.

First, in the insertion step 410, a blind stab, in particular a blind stab 100 as disclosed above with reference to FIGS. 1-3 and 5, is inserted into a hot stab receptacle of a subsea equipment while the equipment is located at a topside location.

Next, in the topside compensation step 420, the blind stab is set in its open state, allowing the fluid contained in the blind stab 100 to be in fluid communication with fluid contained in the subsea equipment while the subsea equipment is located at the topside location. This allows for compensating the fluid contained in the blind stab 100 with respect to topside conditions, in particular the fluid pressure and temperature in the subsea equipment while it is located topside.

Next, in the lowering step 430, the subsea equipment with the blind stab inserted in the hot stab receptacle and in the open state, is lowered to a subsea location, for instance to a seafloor location. The lowering step may be performed by any suitable marine lowering/lifting means, for instance a crane on a floating crane vessel.

Next, in the subsea compensation step 440, the blind stab is retained in the subsea equipment at the subsea location for a period which allows for compensating for the ambient pressure and temperature at the subsea location.

Next, in the blind stab removal step 450, the blind stab 100 is brought to the closed state and removed from the subsea equipment, at the subsea location, by means of a ROV, which operates the blind stab's ROV handle, first rotating the handle to bring the blind stab 100 to the closed state and then withdrawing the blind stab from subsea equipment.

Next, in the subsea operation step 460, an operating stab is inserted into the hot stab receptacle of the subsea equipment. The insertion is also performed by the ROV at the subsea location. The operating hot stab may be a regular hot stab device which establishes a fluid connection between the subsea equipment and an external hydraulic fluid unit, for instance a hydraulic fluid power unit to power the subsea equipment. Also included in the subsea operation step 460 is any regular operation of the subsea equipment while it is connected to the external hydraulic fluid unit.

Next, in the operating hot stab removal step 470, the operating hot stab is removed from the hot stab receptacle of the subsea equipment. The removal is also performed at the subsea location, by the ROV.

Next, in the subsea blind stab insertion step 490, the blind stab is re-inserted into the hot stab receptacle of the subsea equipment and brought to the open state. The insertion is performed by the ROV at the subsea location, the ROV operating the blind stab's ROV handle, first inserting the blind stab into the subsea equipment and then rotating the handle to bring the blind stab 100 to the open state.

Next, in the lifting step 490, the subsea equipment with the blind stab inserted and in the open state, is lifted from the subsea location to a topsea location by means of the marine lowering/lifting means.

The method ends at the terminating step 500.

Consequently, when the blind stab 100 is inserted into the subsea equipment and rotated to its open position, either topside during the topside insertion and opening steps (steps 410 and 415) or subsea during the subsea insertion and opening steps (steps 480 and 485), the fluid chamber 140 is brought into fluid communication with the subsea equipment. This fluid communication will be kept open as long as the blind stab remains inserted in the subsea equipment and in its open position, i.e. also during the lowering step 430 and the lifting step 490. As is evident from FIG. 2, the spring element 160 allows the piston 130 to move relative to the rod 150, thus allowing the volume of the fluid chamber 140 to adapt to pressure and temperature in and around the subsea equipment.

The disclosed subsea blind stab has the advantage that it will take up variations in volume of the hydraulic fluid due to varying pressure and temperature, in particular pressure and temperature variations caused by lowering equipment from a topside location to a subsea location and vice versa. This is by virtue of the spring element 160 providing pretension on the piston 130 but at the same time allowing the piston 130 to move relative to the rod 150, thus allowing the volume of the fluid chamber 140 to adapt to pressure and temperature in and around the subsea equipment. The ability of taking up variations in the hydraulic fluid may also be advantageous in the case of substantial temperature variations at the topside location. When the subsea equipment is lowered to the seabed, the fluid within the blind stab will be forced into the subsea equipment due to the pressure on the piston from the surrounding seawater. The spring element will always keep some pressure within the hydraulic fluid in the subsea equipment due to the pretension of the spring—even when the subsea equipment is topside. Also, when inserted into a subsea equipment, the disclosed subsea blind stab provides a secure functionality for the hydraulic fluid in the equipment to expand due to temperature or pressure variations, while avoiding release of hydraulic fluid to the subsea environment, which functionality, in addition to the above-discussed pressure compensating functionality, normal blind stabs do not have. However, should the pressure in the subsea equipment become excessively high, the check valve 240 provides a safety venting option, allowing fluid to escape the subsea equipment via the fluid chamber 140 in order to prevent damage to the equipment and/or personnel handling the equipment due to entrapped high pressure.

The invention claimed is:

1. A subsea blind stab comprising:

a stabbing part for insertion into a hot stab receptacle, the stabbing part including:

a housing;

a central rod slidably arranged within the housing; and at least one fluid communication line extending from an external side of the stabbing part to an internal fluid communication line within the rod;

the at least one fluid communication line being open in a first position of the rod relative the housing and closed in a second position of the rod relative the housing, wherein the subsea blind stab further comprises:

a hollow body attached to one end of the stabbing part;

a piston slidably arranged in the hollow body; and a spring element arranged between the piston and a spring attachment element connected to the body;

wherein a first side of the piston forms a fluid chamber in the hollow body which is in fluid communication with the internal fluid communication line in the rod, and wherein a second side of the piston is exposed to a pressure of a surrounding environment.

2. The subsea blind stab according to claim 1, wherein the rod is arranged to slidably extend through a bore in the piston.

3. The subsea blind stab according to claim 1, wherein the spring element is arranged around the rod on the second side of the piston.

4. The subsea blind stab according to claim 1, further comprising a check valve arranged between the fluid chamber and the surrounding environment.

5. The subsea blind stab according to claim 4, wherein the check valve is arranged in the piston.

6. The subsea blind stab according to claim 1, wherein an end of the rod is provided with a ROV handle.

7. The subsea blind stab according to claim 6, wherein the end of the rod is also provided with a position indicator which indicates if the rod is in the first or second position.

8. The subsea blind stab according to claim 1, wherein the second side of the piston is exposed to the surrounding environment by means of at least one aperture through the body.

9. The subsea blind stab according to claim 8, wherein the body is formed by two end sections and a side wall.

10. The subsea blind stab according to claim 1, wherein the stabbing part and the body are substantially cylindrical and coaxial.

11. The subsea blind stab according to claim 10, further comprising:

an ROV handle connected to an end of the rod; and a rotary-to-linear conversion mechanism for converting a rotational operation of the ROV handle to an axial movement of the rod.

12. The subsea blind stab according to claim 1, wherein the fluid chamber is filled with hydraulic fluid at a predetermined pressure.

13. A method for protecting a subsea equipment comprising:

inserting a subsea blind stab into a hot stab receptacle of the subsea equipment; or removing the subsea blind stab from the hot stab receptacle of the subsea equipment;

wherein the subsea blind stab comprises:

a stabbing part configured for insertion into the hot stab receptacle and including a housing, a central rod slidably arranged within the housing, and at least one fluid communication line extending from an external side of the stabbing part to an internal fluid communication line within the rod, the at least one fluid communication line being open in a first position of the rod relative the housing and closed in a second position of the rod relative the housing;

a hollow body attached to one end of the stabbing part;

a piston slidably arranged in the hollow body; and a spring element arranged between the piston and a spring attachment element connected to the body;

wherein a first side of the piston forms a fluid chamber in the hollow body which is in fluid communication with the internal fluid communication line in the rod, and wherein a second side of the piston is exposed to a pressure of a surrounding environment.

14. The method for protecting a subsea equipment according to claim 13, wherein the subsea blind stab comprises an ROV handle connected to an end of the rod, and wherein the step of inserting the subsea blind stab into the hot stab receptacle or removing the subsea blind stab from the hot stab receptacle is performed at a subsea location by a Remotely Operated Vehicle (ROV).

* * * * *